US007270859B2

(12) United States Patent
Acevedo et al.

(10) Patent No.: US 7,270,859 B2
(45) Date of Patent: Sep. 18, 2007

(54) INSULATING GLASS ASSEMBLY INCLUDING A POLYMERIC SPACING STRUCTURE

(75) Inventors: Margarita Acevedo, Minneapolis, MN (US); Mai T. Nguyen-Misra, Shoreview, MN (US); Kristen A. Gray, Prescott, WI (US)

(73) Assignee: H.B. Fuller Licensing & Financing Inc., St. Paul, MN (US)

( * ) Notice: Subject to any disclaimer, the term of this patent is extended or adjusted under 35 U.S.C. 154(b) by 101 days.

(21) Appl. No.: 10/852,862

(22) Filed: May 25, 2004

(65) Prior Publication Data

US 2004/0258859 A1 Dec. 23, 2004

Related U.S. Application Data

(60) Provisional application No. 60/474,061, filed on May 28, 2003.

(51) Int. Cl.
*E06B 3/00* (2006.01)
*E06B 7/12* (2006.01)
*E04C 2/54* (2006.01)

(52) U.S. Cl. ..... 428/34; 52/172; 52/786.13

(58) Field of Classification Search ..... 428/34; 52/786.1, 786.13, 172
See application file for complete search history.

(56) References Cited

U.S. PATENT DOCUMENTS 3,758,996 A 9/1973 Bowser
3,919,023 A * 11/1975 Bowser et al. ..... 156/107
4,015,394 A 4/1977 Kessler
4,109,431 A 8/1978 Mazzoni et al.
4,215,164 A 7/1980 Bowser
4,226,063 A 10/1980 Chenel
4,233,796 A 11/1980 Mazzoni et al.
4,431,691 A 2/1984 Greenlee
4,807,419 A 2/1989 Hodek et al.
4,820,368 A 4/1989 Markevka et al.
4,831,799 A 5/1989 Glover et al.
4,891,269 A 1/1990 Markevka et al.
5,013,377 A 5/1991 Lafond
5,177,916 A 1/1993 Misera et al.
5,313,761 A 5/1994 Leopold (Continued)

FOREIGN PATENT DOCUMENTS

CA 2258585 12/1997

(Continued)

OTHER PUBLICATIONS

ASTM F 1249-90, "Standard Test Method for Water Vapor Transmission Rate Through Plastic Film and Sheeting Using a Modulated Infrared Sensor", pp. 1168-1172 (1990).

(Continued)

*Primary Examiner*—Donald J. Loney

(57) ABSTRACT

Disclosed is an insulating glass assembly that limits the presence and transmission of volatile components into the airspace of an insulating glass assembly and includes a polymeric spacing structure including a first side wall, a second side wall, and a third wall at least substantially perpendicular to the first side wall and the second side wall, a first pane of glass bonded to the first side wall through a sealant composition, a second pane of glass bonded to the second side wall through a sealant composition, and a desiccant matrix composition disposed on the spacing structure, the desiccant matrix composition including adsorbent and polymer.

10 Claims, 4 Drawing Sheets

U.S. PATENT DOCUMENTS

| | | | | |
|---|---|---|---|---|
| 5,447,761 | A * | 9/1995 | Lafond | 428/34 |
| 5,503,884 | A | 4/1996 | Meyer et al. | |
| 5,509,984 | A | 4/1996 | Meyer et al. | |
| 5,510,416 | A | 4/1996 | Meyer et al. | |
| 5,531,047 | A | 7/1996 | Leopold et al. | |
| 5,632,122 | A | 5/1997 | Spinks | |
| 5,653,073 | A | 8/1997 | Palmer | |
| 5,655,282 | A * | 8/1997 | Hodek et al. | 29/469.5 |
| 5,691,045 | A | 11/1997 | Lafond | |
| 5,849,832 | A | 12/1998 | Virnelson et al. | |
| 5,863,857 | A | 1/1999 | Lamb et al. | |
| 5,873,203 | A | 2/1999 | Thiel | |
| 6,035,602 | A | 3/2000 | Lafond | |
| 6,055,783 | A | 5/2000 | Guhl et al. | |
| 6,112,477 | A | 9/2000 | Spinks | |
| 6,121,354 | A | 9/2000 | Chronister | |
| 6,136,910 | A | 10/2000 | Virnelson et al. | |
| 6,212,756 | B1 | 4/2001 | Ferri | |
| 6,223,414 | B1 | 5/2001 | Hodek et al. | |
| 6,266,940 | B1 | 7/2001 | Reichert | |
| 6,286,288 | B1 | 9/2001 | France | |
| 6,355,317 | B1 | 3/2002 | Reid et al. | |
| 6,401,428 | B1 | 6/2002 | Glover et al. | |
| 6,420,002 | B1 | 7/2002 | Aggas et al. | |
| 6,463,706 | B1 | 10/2002 | Guhl et al. | |
| 6,470,561 | B1 | 10/2002 | Misera et al. | |
| 6,536,182 | B2 | 3/2003 | France | |
| 6,777,481 | B2 | 8/2004 | Chu | |
| 2002/0189196 | A1 | 12/2002 | Homung et al. | |
| 2002/0189743 | A1 | 12/2002 | Homung et al. | |
| 2002/0194813 | A1 | 12/2002 | Vimelson et al. | |
| 2003/0072899 | A1 | 4/2003 | Compton et al. | |
| 2003/0084622 | A1 | 5/2003 | Homung et al. | |
| 2003/0089054 | A1 | 5/2003 | Homung | |

FOREIGN PATENT DOCUMENTS

| | | |
|---|---|---|
| DE | 951040 | 9/1956 |
| DE | 196 25 845 A1 | 1/1998 |
| EP | 0 475 213 B1 | 1/1995 |
| FR | 2301678 | 9/1976 |
| FR | 2612244 | 9/1988 |
| WO | WO97/36966 A1 | 10/1997 |
| WO | WO98/25001 | 6/1998 |
| WO | WO99/14169 | 3/1999 |

OTHER PUBLICATIONS

ASTM E 1887-97, "Standard Test Method for Fog Determination", pp. 1-3 (1997).

National Standard of Canada CAN/CGSB-12.8-97, "Insulating Glass Units", 1-7,9, 11, 13, 15, 17, 19, A1, B1, B2, C1, D1, D2, (1997).

ASTM E 773-97, "Standard Test Method for Accelerated Weathering of Sealed Insulating Glass Units", pp. 208-212 (1997).

ASTM E 774-88, "Standard Specification for Sealed Insulating Glass Unit", pp. 1-3 (1988).

ASTM E 546-88, "Standard Test Method for Frost Point of Sealed Insulating Glass Units", pp. 475-479 (1988).

ASTM D 1823-95, "Standard Test Method for Apparent Viscosity of Plastisols and Organosols at High Shear Rates by Extrusion Viscometer", pp. 438-440 (1995).

ASTM D 2202-93a, "Standard Test Method for Slump of Sealants", pp. 406-409 (1993).

* cited by examiner

INSULATING GLASS ASSEMBLY INCLUDING A POLYMERIC SPACING STRUCTURE

CROSS-REFERENCE TO RELATED APPLICATIONS

This application claims the benefit of U.S. Provisional Application No. 60/474,061, filed May 28, 2003.

BACKGROUND

The invention relates to limiting the presence and transmission of volatile components into the airspace of an insulating glass assembly.

Insulating glass assemblies such as insulating glass (IG) units and insulating sash assemblies often include a pair of glass panes maintained in a fixed spaced relation to each other by a spacing structure and sealing composition(s) that extend around the periphery of the inner facing surfaces of the glass sheets to define a sealed and insulating space between the glass panes. In the case of insulating sash assemblies, the spacing structure is an integral part of the sash frame and the glass panes are attached to the spacing structure by a sealant or adhesive composition. The sealant or adhesive composition is also used to seal the edges of the insulating glass assembly so as to establish a barrier that prevents moisture from penetrating into the interior of the assembly and potentially to prevent thermal property improvement gases, like argon, from leaving the airspace.

Insulating glass assemblies also include a desiccant disposed in the spacing structure. The desiccant can be in various forms including loose particles, powders and desiccant matrix compositions. Desiccant matrix compositions include a polymer matrix (i.e., carrier) and adsorbent disposed in the matrix. The adsorbents are capable of adsorbing moisture, volatile organic compounds, other volatile chemicals or combinations thereof.

The desiccant functions to remove moisture, and potentially chemical volatiles, from the sealed chamber of the insulating glass assembly, which if not removed can contribute to the visual appearance of chemical condensation on the glass surfaces, which is known as chemical fogging. Fog can form from moisture and volatile organic compounds present in the sealed chamber when the insulating glass assembly is manufactured, as well as volatile organic compounds emitted by various polymeric components of an insulating glass assembly.

Spacing structures traditionally have been in the form of a U-shaped metal channel. Recently polymeric spacing structures have been described for use in the construction of insulating glass assemblies. Polymeric spacing structures provide benefits in terms of the heat transmission performance of the assembly, one measure of which is referred to as the "U Factor" by those in the window industry. Polymeric spacing structures made from polyvinyl chloride have exhibited off-gassing of organic components when incorporated in insulating glass units. Polyvinyl chloride is also known to be moisture vapor permeable. It has been difficult to achieve acceptable performance from insulating glass assemblies that include a polymeric spacing structure using existing desiccant matrix compositions Vapor barriers in the form of metal foils, electrostatic powder coatings, and chemical vapor deposition have been suggested for use on polyvinyl chloride spacing structures to prevent vapor from transmitting through the spacing structure and into the sealed airspace of the insulating glass assembly. However, applying such vapor barriers requires additional processing steps. In addition, the presence of a metal component such as a metal vapor barrier reduces the U Factor of the assembly.

SUMMARY

In one aspect, the invention features an insulating glass assembly that includes a polymeric spacing structure that includes a first side wall, a second side wall, and a third wall at least substantially perpendicular to the first side wall and the second side wall, a sealant composition, a first pane of glass bonded to the first side wall through the sealant composition, a second pane of glass bonded to the second side wall through the sealant composition, and a desiccant matrix composition in contact with the spacing structure, the desiccant matrix composition comprising adsorbent and polymer, the insulating glass assembly, when tested according to the Canadian Fog Test Method, passes.

In one embodiment, the bottom wall of the spacing structure extends from the first side wall of the spacing structure to the second side wall of the spacing structure to form a U-shaped channel, the first side wall having an inner surface and a top surface positioned substantially perpendicular to the inner surface, and the second side wall having an inner surface and a top surface positioned substantially perpendicular to the inner surface, the desiccant matrix composition contacts the bottom wall, the first side wall and the second side wall, and the exposed surface of the desiccant matrix composition, the top surface of the first wall and the top surface of the second wall form a substantially planar surface.

In other embodiments, the bottom wall of the spacing structure extends from the first side wall of the spacing structure to the second side wall of the spacing structure to form a U-shaped channel, the first side wall having an inner surface and a top surface positioned substantially perpendicular to the inner surface, and the second side wall having an inner surface and a top surface positioned substantially perpendicular to the inner surface, the desiccant matrix composition contacts the bottom wall, the first side wall and the second side wall, and the exposed surface of the desiccant matrix composition extends above the plane of the top surface of at least one of the first wall and the second wall.

In another embodiment, the bottom wall of the spacing structure extends from the first side wall of the spacing structure to the second side wall of the spacing structure to form a U-shaped channel, the first side wall having an inner surface and a top surface positioned substantially perpendicular to the inner surface, and the second side wall having an inner surface and a top surface positioned substantially perpendicular to the inner surface, the desiccant matrix composition contacts the bottom wall, the first side wall, the second side wall, and at least a portion of the top surface the first wall.

In some embodiments, the bottom wall of the spacing structure extends from the first side wall of the spacing structure to the second side wall of the spacing structure to form a U-shaped channel, the first side wall having an inner surface and a top surface positioned substantially perpendicular to the inner surface, and the second side wall having an inner surface and a top surface positioned substantially perpendicular to the inner surface, and the desiccant matrix composition contacts the bottom wall, the first side wall, the second side wall, at least a portion of the top surface the first wall and at least a portion of the top surface of the second wall.

In one embodiment, the desiccant matrix composition is present in the channel in an amount from about 4 grams desiccant matrix composition per lineal foot to about 25 grams desiccant matrix composition per lineal foot.

In another embodiment, the desiccant matrix composition includes a multilayer desiccant matrix composition comprising a first layer comprising an ambient applied desiccant matrix composition having a flow rate of at least 5 seconds at 25° C. and comprising polymer and at least 15% by weight adsorbent, and a second layer comprising an ambient applied desiccant matrix composition having a flow rate of at least 5 seconds at 25° C. and comprising a polymer and at least 30% by weight adsorbent, the ambient applied composition of the second layer being different from the ambient applied composition of the first layer, the second layer being exposed to the airspace of the chamber formed by the spacer and the first and second panes of glass.

In some embodiments, the desiccant matrix composition includes a multilayer desiccant matrix composition comprising a first layer comprising a composition selected from the group consisting of a hot melt composition comprising thermoplastic polymer and an ambient applied desiccant matrix composition comprising polymer and adsorbent having a flow rate of at least 5 seconds at 25° C.; and a second layer comprising a desiccant matrix composition selected from the group consisting of a hot melt composition comprising thermoplastic polymer and adsorbent and an ambient applied composition having a flow rate of at least 5 seconds at 25° C. and comprising a polymer and adsorbent, the second layer being exposed to the airspace of the chamber formed by the spacer and the first and second panes of glass.

In one embodiment, the composition of the first layer exhibits a MVTR of no greater than 5 $g/m^2$/day. In other embodiments, the matrix of the composition of the second layer exhibits an MVTR of at least 5 $g/m^2$/day. In some embodiments, the composition of the first layer exhibits an MVTR that is less than the MVTR of the matrix of the composition of the second layer.

In other embodiments, the insulating glass assembly exhibits a dew point depression of no greater than −50° F. after seven days.

In another embodiment, the desiccant matrix composition has a flow rate of from 40 seconds to 200 seconds at 25° C. In other embodiments, the polymer of the composition of the first layer includes polyisobutylene. In another embodiment, the polymer of the composition of the second layer includes silane-functional polymer. In some embodiments, the composition of the first layer includes a hot melt composition and the desiccant matrix composition of the second layer includes an ambient applied desiccant matrix composition.

In other embodiments, the desiccant matrix composition includes a multilayer desiccant matrix composition comprising: a first layer comprising a hot melt applied desiccant matrix composition comprising thermoplastic polymer, and adsorbent, the hot melt applied desiccant matrix composition having a viscosity no greater than 750,000 centipoise at 350° F., and a second layer comprising a hot melt applied desiccant matrix composition comprising thermoplastic polymer, and adsorbent, the hot melt applied desiccant matrix composition of the second layer having a viscosity no greater than 750,000 centipoise at 350° F., the hot melt applied desiccant matrix composition of the second layer being different from the hot melt applied desiccant matrix composition of the first layer.

In one embodiment, the ambient applied composition includes a silane functional polymer, plasticizer, metal stearate, organic modified clay, and adsorbent. In other embodiments, the ambient applied composition includes hydrogen-bonding polymer, plasticizer, organic-modified clay, and adsorbent. In another embodiment, the hot melt composition includes ethylene-alphaolefin copolymer, polybutene, and adsorbent.

In another aspect, the invention features a process for making an insulating glass assembly that includes a polymeric spacing structure, the method including applying a first composition at a temperature from greater than 38° C. to 150° C. on a surface of the polymeric spacing structure, the first composition comprising a polymer, and applying a second composition at a temperature from 10° C. to less than 38° C. on the first composition, the second composition comprising polymer and adsorbent.

In one embodiment, the process for making an insulating glass assembly that includes a polymeric spacing structure, includes applying a first composition at a temperature from 10° C. to 150° C. on a surface of the polymeric spacing structure, the first composition comprising a polymer and adsorbent, and applying a second composition exhibiting a temperature from 10° C. to 150° C. on the first composition, the second composition comprising polymer and adsorbent.

In other embodiments, applying the first composition including applying the first composition at a temperature from 10° C. to less than 38° C. and applying the second composition includes applying the second composition at a temperature from 10° C. to less than 38° C.

In some embodiments, applying the first composition includes applying the first composition at a temperature from greater than 38° C. to 150° C. and applying the second composition includes applying the second composition at a temperature from 10° C. to less than 38° C.

In another embodiment, applying the first composition includes applying the first composition at a temperature from greater than 38° C. to 150° C. and applying the second composition includes applying at a temperature from greater than 38° C. to 150° C.

In some embodiments, applying the first composition and applying the second composition occur simultaneously.

In other embodiments, applying the first composition to the spacing structure occurs prior to applying the second composition to the first composition.

The invention features insulating glass assemblies that exhibit acceptable dew point depression and resistance to the visual appearance of chemical condensation on the glass surfaces of the assembly. The inventors have made the surprising discovery that, by placing a desiccant matrix composition in direct contact with a polymeric spacing structure and at least substantially filling the channel of a polymeric spacing structure of an insulating glass assembly with a desiccant matrix composition, the assembly is capable of passing Canadian Fog Test CAN/CGSB-12.8-97.

The inventors have also made the surprising discovery that, by placing a desiccant matrix composition in direct contact with a polymeric spacing structure and at least substantially covering the exposed surface area of the interior of a channel of a polymeric spacing structure of an insulating glass assembly with a desiccant matrix composition, the assembly is capable of passing Canadian Fog Test CAN/CGSB-12.8-97.

The invention also features a direct volatile adsorption system in which the desiccant matrix composition is in contact with the polymeric spacing structure and adsorbs volatiles released from the polymeric spacing structure directly from the spacing structure. The direct volatile adsorption system adsorbs volatiles emitted from the spacing structure preferably such that the volatiles do not reach the airspace of the chamber.

Other features and advantages will be apparent from the following description of the preferred embodiments and from the claims.

GLOSSARY

In reference to the invention, these terms have the meanings set forth below:

"Moisture vapor transmission rate," MVTR, as used herein is determined according to ASTM F1249-90 entitled, "Standard Test Method for Water Vapor Transmission Rate Though Plastic Film and Sheeting using a Modulated Infrared Sensor." The test is conducted at approximately 37° C. (100° F.) and 90% relative humidity on a film of sample having a thickness of 60 mils. For compositions that include adsorbent, MVTR is determined on the matrix of the composition.

"Matrix" means the carrier of the desiccant matrix composition and includes all of the components of the desiccant matrix composition except the adsorbent.

"Ambient applied" refers to the ability to flow at room temperature and exhibit a flow rate of at least 5 seconds at 25° C.

"Hot melt" refers to a composition that is solid at room temperature and is flowable at elevated temperatures.

"The Canadian Fog Test Method" refers to the Canadian Fog Test Method set forth in the Examples section below.

The abbreviation "$g/m^2/day$" stands for grams per square meter per day.

DRAWINGS

DETAILED DESCRIPTION

Figure 1:
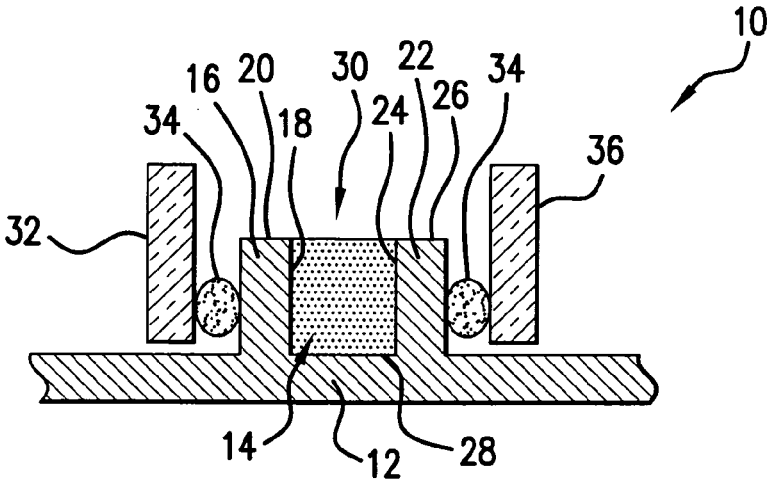
FIG. 1 is a cross-section of an insulating glass assembly that includes a desiccant matrix composition disposed in a channel of a spacing structure.

The present inventors have discovered that polyvinylchloride extrusions used in the window manufacturing industry off gas volatile components upon exposure to elevated temperatures, ultraviolet radiation and combinations thereof. The present inventors have also discovered that the off-gassed volatile components can include, e.g., acetophenone, 2-phenyl-2-propanol, 2-ethylhexyl acetate, 1-butanol, 2-ethyl hexanol and combinations thereof. The present inventors have also discovered that polyvinylchloride extrusions prepared for the window manufacturing industry contain moisture and tend to release moisture upon exposure to elevated temperatures.

The insulating glass assembly includes a polymeric spacing structure (e.g., polyvinylchloride) disposed between the panes of glass and a desiccant matrix composition in contact with the spacing structure. The insulating glass assembly is capable of passing the Canadian Fog Test Method and preferably has a dew point depression of no greater than −50° F., no greater than −60° F., or even no greater than −80° F., after seven days, after two weeks, or even after one month. The insulating glass assembly, when tested according to ASTM E774-88 entitled, "Standard Specification for Sealed Insulating Glass Units," in conjunction with ASTM E773-97 entitled, "Standard Test Method for Accelerated Weathering of Sealed Insulating Glass Units," hereinafter referred to as "ASTM E774/773," also preferably passes the Class C performance requirements, Class CB performance requirements, or even Class CBA performance requirements. The insulating glass assembly, when tested according to ASTM E1887-97 entitled, "Standard Test Method for Fog Determination," preferably is also free of visible fog.

The panes of glass, which are bonded to the polymeric spacing structure through a sealant composition, and the spacing structure combine to form a sealed chamber. At least a portion of the desiccant matrix composition of the insulating glass assembly is exposed to the airspace of the sealed chamber.

The polymeric spacing structure is formed from polymer including, e.g., thermoplastic polymers, thermoset polymers and combinations thereof. Suitable thermoplastic polymers include polyvinylchloride. The polymeric spacing structure can also include other additives including, e.g., heat stabilizers, impact modifiers, processing aids, waxes and combinations thereof.

Suitable polymeric spacing structures include polymeric spacing structures that are integral with the frame of the assembly (e.g., the frame of a window), as well as spacing structures that are separate from the frame of the assembly. Examples of useful polymeric spacing structures are described in U.S. Pat. Nos. 6,536,182 (France) and 6,286,288 (France), 6,463,706 (Guhl et al.), 6,401,428 (Glover et al.), 6,055,783 (Guhl et al.), 5,653,073 (Palmer), U.S. Patent Application Publication NO. 2003/0089054 (Hornung), and PCT Publication Nos. WO 99/14169 (Guhl et al.) and WO 98/25001 (France), and incorporated herein.

An example of a useful insulating glass assembly includes a U-shaped polymeric spacing structure, i.e., a spacing structure that includes a channel defined by a first side wall, a second side wall and a bottom wall disposed between the first side wall and the second side wall, and a desiccant matrix composition that is in contact with the channel and sufficiently fills the channel, sufficiently covers the interior surface of the channel, or a combination thereof, such that the insulating glass assembly passes the Canadian Fog Test Method. The desiccant matrix composition preferably covers and is in contact with at least 50%, at least 70%, at least 80%, at least 90%, at least 95% or even 100% of the interior surface of the channel. In one preferred embodiment, the desiccant matrix composition forms a substantially planar surface with the surfaces of the channel that are exposed to the sealed chamber of the insulating glass assembly. The desiccant matrix composition can also extend beyond the volume defined by the channel and into the volume of the sealed chamber. Preferably the insulating glass assembly includes from 4 gram of desiccant matrix composition per lineal foot, i.e., the perimeter of the outer edge of the assembly, (g/lineal foot) to 50 g/lineal foot, from 6 g/lineal foot to 50 g/lineal foot, at least 10 g/lineal foot, no greater than 30 g/lineal foot, no greater than 20 g/lineal foot, or even no greater than 15 g/lineal foot.

Insulating glass assemblies having a variety of desiccant matrix composition configurations and spacing structures are contemplated. FIGS. 1-10, for example, illustrate various embodiments of the insulating glass assembly in which the desiccant matrix composition exists in a variety of configurations. FIG. 1 illustrates an embodiment of an insulating glass assembly 10 that includes a spacing structure 12, and a desiccant matrix composition 30 disposed in a channel 14 of the spacing structure 12. The channel 14 includes a first side wall 16 having an inner surface 18 and a top surface 20, a second side wall 22 having an inner surface 24 and a top surface 26, and a bottom wall 28 extending from the first side wall 16 to the second side wall 22. The desiccant matrix composition 30, the top surface 20 of first side wall 16 and the top surface 26 of second side wall 22 are in substantially the same plane. A first pane of glass 32 is bonded to the first side wall 16 (i.e., a first glazing surface) of the channel 14 through a sealant composition 34 and a second pane of glass 36 is bonded to the second side wall 22 (i.e., a second glazing surface) through the sealant composition 34.

Figure 2:
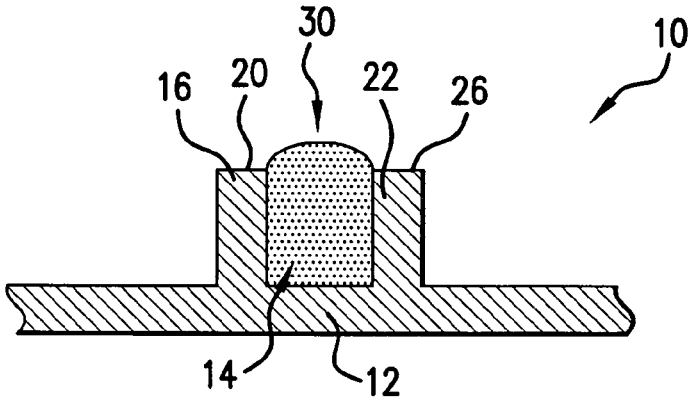
FIG. 2 is a cross-section of a second desiccant matrix configuration in a channel of an insulating glass assembly.
Figure 3:
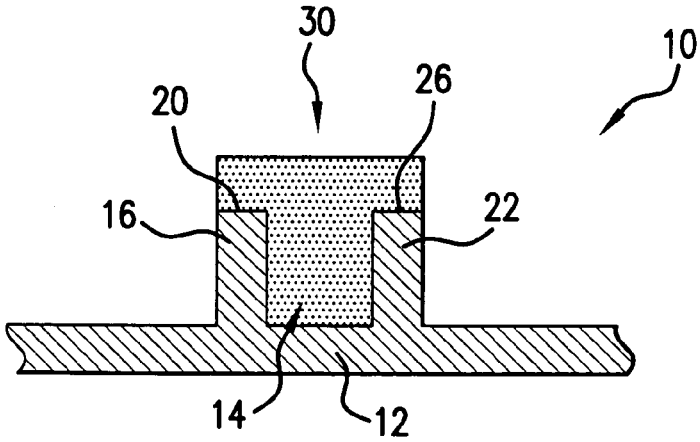
FIG. 3 is a cross-section of a third desiccant matrix configuration in a channel of an insulating glass assembly.

FIG. 2 illustrates a spacing structure 12 in which the desiccant matrix composition 30 is disposed in the channel 14 of the spacing structure 12 and extends above the plane of the top surface 20 of first side wall 16 and the top surface 26 of second side wall 22. Alternately, the desiccant matrix composition 30 can extend across at least a portion of the top surfaces 20, 26 of the side walls 16 and 22 of the spacing structure, an example of which is illustrated in FIG. 3.

Figure 4:
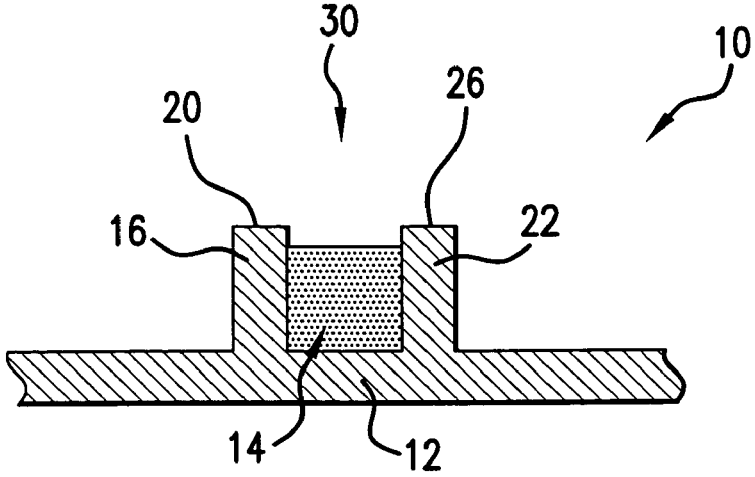
FIG. 4 is a cross-section of a fourth desiccant matrix configuration in a channel of an insulating glass assembly.

FIG. 4 illustrates a spacing structure 12 in which the desiccant matrix composition 30 disposed in the channel 14 of the spacing structure 12 resides below the plane of the top surface 20 of first side wall 16 and the top surface 26 of second side wall 22.

Figure 5:
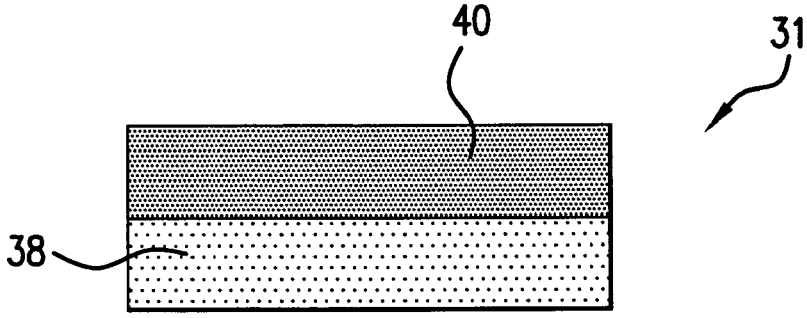
FIG. 5 is a cross-section of a multilayer desiccant matrix composition.
Figure 6:
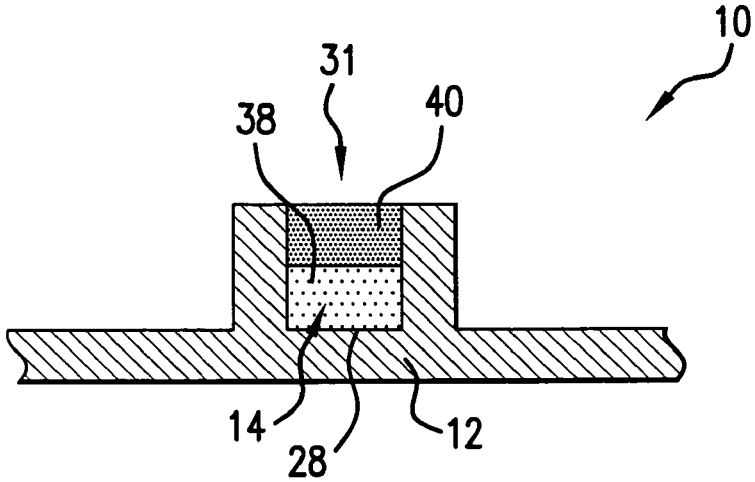
FIG. 6 is a cross-section of a second multilayer desiccant matrix configuration in a channel of an insulating glass assembly.

FIG. 5 illustrates a multilayer desiccant matrix composition 31 that includes a first layer 38 and a second layer 40 disposed on the first layer 38. FIG. 6 illustrates a multilayer desiccant matrix composition 31 disposed in the channel 14 of a spacing structure 12 of an insulating glass assembly 10. The multilayer desiccant matrix composition 31 includes a first layer 38 in contact with the bottom wall 28 of the channel 14 and a second layer 40 disposed on the first layer 38 and exposed to the airspace of the insulating glass assembly 10.

Figure 7:
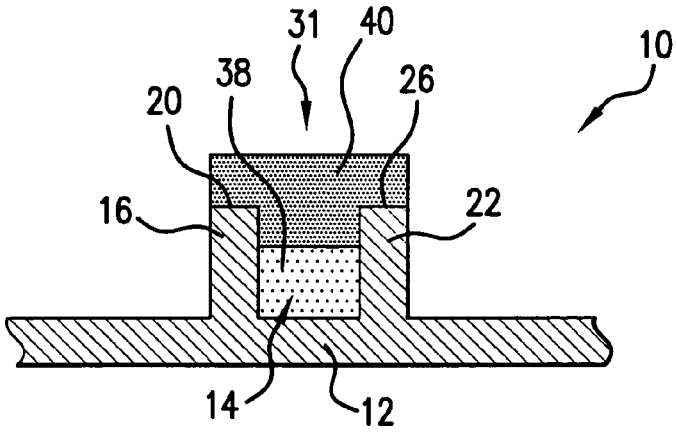
FIG. 7 is a cross-section of a third multilayer desiccant matrix configuration in a channel of an insulating glass assembly.

FIG. 7 illustrates a configuration of the multilayer desiccant matrix composition 31 in which a portion of the second layer 40 of the desiccant matrix composition extends across the top surfaces 20, 26 of the side walls 16, 22 of the spacing structure 12.

Figure 8:
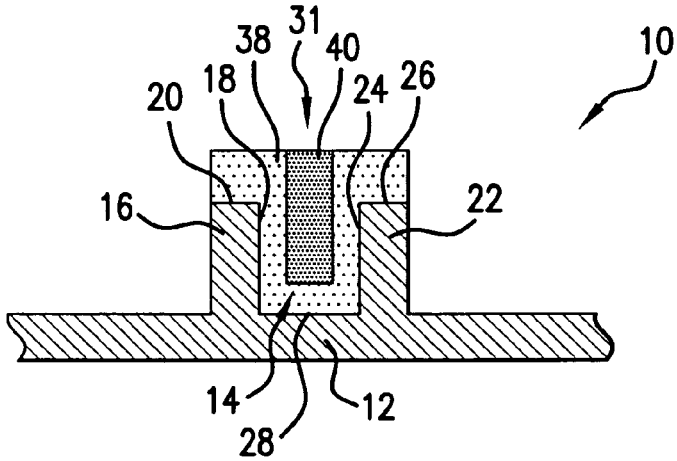
FIG. 8 is a cross-section of another desiccant matrix configuration in a channel of an insulating glass assembly.
Figure 9:
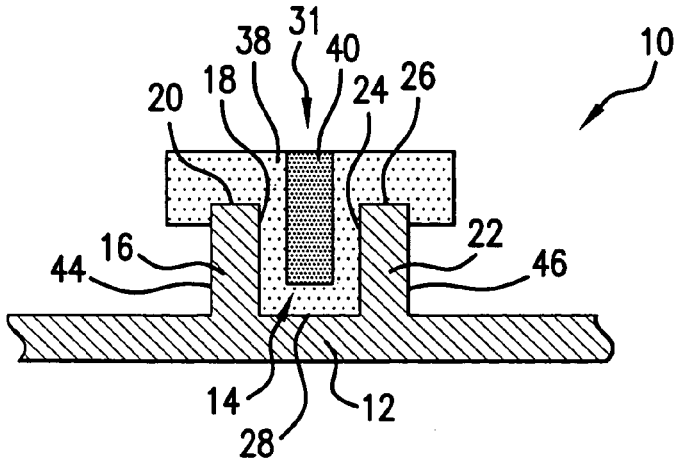
FIG. 9 is a cross-section of another desiccant matrix configuration in a channel of an insulating glass assembly.

FIG. 8 illustrates a spacing structure 12 that includes a multilayer desiccant matrix composition 31 in which the first layer 38 is in contact with a channel 14 of the spacing structure 12 and is generally U-shaped such that the first layer provides a direct volatile adsorption function, a vapor barrier, or a combination thereof. The first layer 38 is in continuous contact with the inner surface 18 and the top surface 20 of the first side wall 16, the inner surface 24 and the top surface 26 of the second side wall 22, and the bottom wall 28. The first layer 38 can inhibit or prevent vapor such as organic vapors, moisture vapor, other chemical vapors, or a combination thereof, from transferring across the barrier. The second layer 40 of the multilayer desiccant matrix composition 31 is disposed in the U-shaped first layer 38 and forms a substantially planar surface with the exposed top surfaces of the U-shaped first layer 38. FIG. 9 illustrates a configuration in which the first layer 38 extends over a portion of the outer surfaces 44, 46 (i.e., glazing surface) of the side walls 16, 22 of the channel 14 the assembly.

Figure 10:
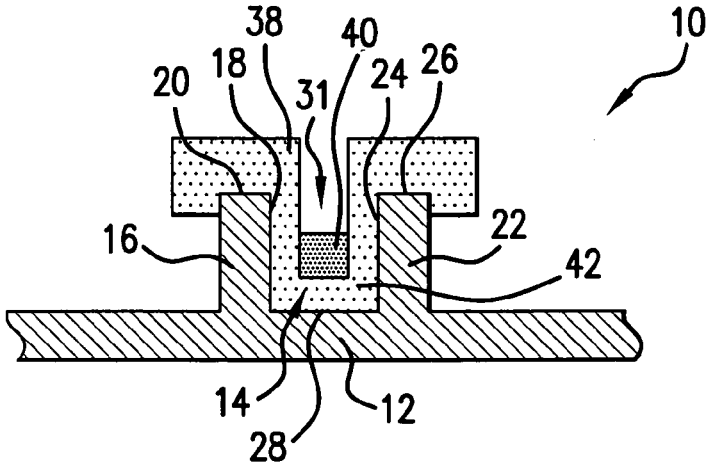
FIG. 10 is a cross-section of another desiccant matrix configuration in a channel of an insulating glass assembly.

FIG. 10 illustrates a spacing structure 12 in which the first layer 38 of the multilayer desiccant matrix composition 31 provides a direct volatile adsorption function, a vapor barrier, or a combination thereof in the channel 14. The first layer 38 is in continuous contact with the inner surface 18 and the top surface 20 of the first side wall 16, the inner surface 24 and the top surface 26 of the second side wall 22, and the bottom wall 28 such that the first layer 38 is generally U-shaped. The second layer 40 of the desiccant matrix composition 31 is disposed in the U-shaped first layer 38 below the plane of the top surface 20 of the first side wall 16 and the top surface 26 of the second side wall 22.

Figure 11:
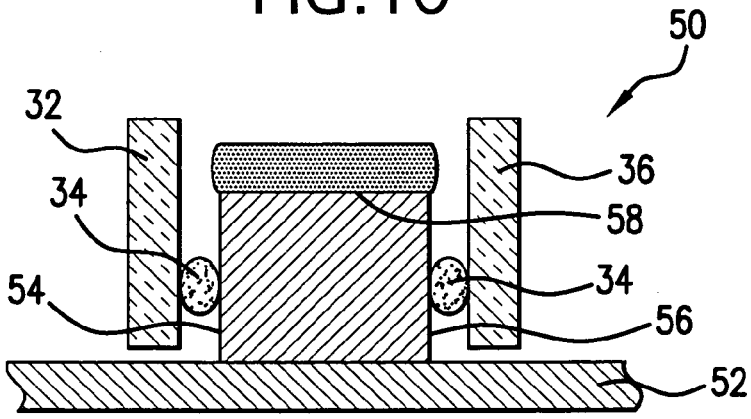
FIG. 11 is a cross-section of a second embodiment of an insulating glass assembly that includes a desiccant matrix composition disposed in a channel of a spacing structure.

FIG. 11 illustrates an insulating glass assembly 50 that includes a spacing structure 52 that includes two side walls 54, 56 and a third wall 58 extending from the first side wall 54 to the second side wall 56, a first pane of glass 32 bonded to the first side wall 54 through a sealant composition 34, and a second pane of glass 36 bonded to the second side wall 56 through a sealant composition 34.

Figure 12:
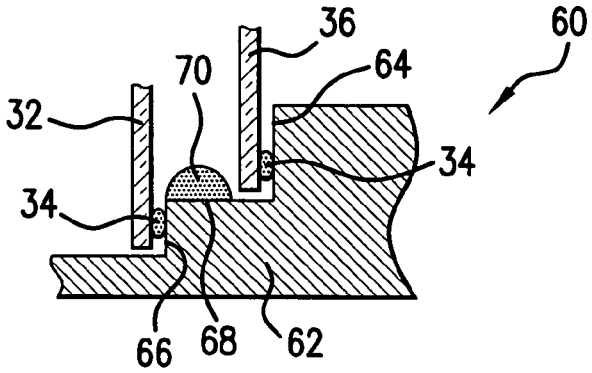
FIG. 12 is a cross-section of a third embodiment of an insulating glass assembly that includes a desiccant matrix composition disposed in a channel of a spacing structure.

FIG. 12 illustrates an insulating glass assembly 60 that includes a spacing structure 62 having a first side wall 66, a second side wall 64 and a third wall 68, a desiccant matrix composition 70 in contact with the third wall 68, a first pane of glass 32 bonded to the first side wall 66 through a sealant composition 34, and a second pane of glass 36 bonded to the second side wall 64 through a sealant composition 34.

Figure 13:
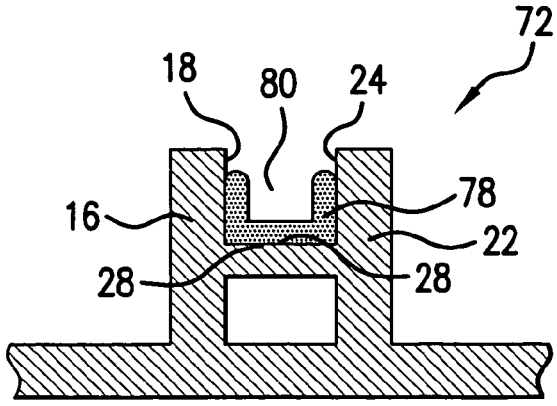
FIG. 13 is a cross-section of a fourth embodiment of an insulating glass assembly that includes a desiccant matrix composition disposed in a channel of a spacing structure.

FIG. 13 illustrates a spacing structure 72 that includes a desiccant matrix composition 78 in contact with and covering a major portion of the interior surface of a channel 80 of the spacing structure 72. The desiccant matrix composition is generally U-shaped such that the desiccant matrix composition 78 provides a direct volatile adsorption function, a vapor barrier, or a combination thereof. The desiccant matrix composition 78 is in continuous contact with the interior surfaces 18, 24, and 28 of the side walls 16, 22, and bottom wall 28 of the channel 80. The desiccant matrix composition 78 can inhibit or prevent vapor such as organic vapors, moisture vapor, other chemical vapors, or a combination thereof, from transferring there through.

The desiccant matrix composition can function to directly adsorb volatile chemicals released from or transmitted through the spacing structure of an insulating glass assembly. Preferably the desiccant matrix composition, or the first layer in the case of a multilayer desiccant matrix composition, is in contact with the spacing structure in a manner sufficient to directly adsorb volatile chemicals released from the spacing structure and to prevent or inhibit volatile chemicals from passing into the sealed airspace of the insulating glass assembly. The first layer also impedes and preferably prevents volatile chemicals from entering the airspace of the sealed chamber through the polymeric spacing structure or from the atmosphere exterior to the assembly.

Various desiccant matrix compositions are suitable for the first and second layers of the multilayer desiccant matrix composition including, e.g., ambient applied desiccant matrix compositions (e.g., ambient applied, atmospheric curable desiccant matrix compositions) and hot melt desiccant matrix compositions. Preferably the ambient applied desiccant matrix composition exhibits a flow rate of from 40 seconds to 300 seconds, from 60 seconds to 200 seconds, or even from 70 seconds to 180 seconds, at 25° C. Where the ambient applied desiccant matrix composition is curable, it is to be understood that the flow rate at 25° C. refers to the flow rate of the composition prior to cure. The desiccant matrix composition preferably remains in place when applied to a substrate and is free of visible sag and slump. Preferably the ambient applied desiccant matrix composition exhibits a slump of no greater than 0.25 inch, no greater than 0.10 inch, or even no greater than 0.05 inch, at room temperature. The ambient applied desiccant matrix composition also preferably exhibits a slump of no greater than 0.3 inch, or even no greater than 0.1 inch, after one week at 190° F., or even after two weeks at 190° F.

One example of a suitable atmospheric curable, ambient applied desiccant matrix composition includes silane-functional polymer, plasticizer, adsorbent and, optionally, catalyst, organic-modified clay and combinations thereof. The silane functional polymer includes at least two silane groups available for reaction with a component of the atmosphere (e.g., oxygen water or a combination thereof). Preferably the silane functional polymers are silane terminated. Suitable silane-functional polymers include silane-containing polyethers (e.g., silyl-terminated polyethers and alkoxy silane terminated polyethers), moisture curable silane-functional polyurethanes (e.g., alkoxy silane terminated polyurethanes), polydimethylsiloxane polymers, silane-terminated polyisobutylene, and combinations thereof. Useful commercially available silane-functional polymers include, e.g., silyl-terminated polyether available under the trade designations KANEKA MS POLYMER S303H from (Kaneka Corp., Japan), silane-functional polyurethanes available under the trade designation PERMAPOL MS from PPG Industries Inc, (Pittsburgh, Pa.), and silane terminated polyisobutylene available under the trade designation KANEKA EPION from Kaneka Corp.

Useful plasticizers include phthalate esters, chlorinated paraffins, mineral oils, and combinations thereof. Examples of useful phthalate esters include diisononyl phthalate, diisodecyl phthalate, ditridecyl phthalate, and mixtures thereof. Useful phthalate ester plasticizers are commercially available under the JAYFLEX DTDP trade designation from (ExxonMobil, Houston Tex.) and SANTICIZER from Solutia Inc. (St. Louis, Mo.). Preferably the ambient applied desiccant matrix composition includes from 0% by weight to 30% by weight, or even from 5% by weight to 20% by weight plasticizer.

The adsorbent is capable of adsorbing molecules present in the atmosphere to which the adsorbent is exposed including, e.g., moisture, low molecular weight organic compounds (e.g., volatile organic compounds), other chemical vapors, and combinations thereof. Preferably the adsorbent is an inorganic particulate (e.g., powder). The adsorbent preferably has a particle size no greater than 10 microns, or even no greater than 5 microns, and an average pore size preferably no greater than about 10 Angstrom, no greater than 5 Angstrom, or even no greater than 3 Angstrom. Useful adsorbents include natural zeolite (e.g. chabasite, gumerinite, levynite, erinite, mordenite and analcite), molecular sieves (e.g., alkali metal alumino-silicates), silica gel, silica-magnesia gel, silica-alumina gel, activated carbon, activated alumina, calcium oxide, and combinations thereof. Suitable alkali metal alumino-silicate molecular sieves include, e.g., calcium, potassium and sodium alkali metal alumino silicates.

Useful molecular sieves are commercially available under the trade designations MOLSIV ADSORBENT TYPE 13X, 3A, 4A and 5A, all of which are available from UOP (Illinois), and PURMOL 3A from Zeochem (Louisville, Ky.). Molecular sieves are also available from W. R. Grace (Maryland), and under the SILIPORITE NK30AP and 65XP trade designations from Atofina (Philadelphia, Pa.). The desiccant matrix composition preferably includes at least 20% by weight, from 20% by weight to about 85% by weight, from about 30% by weight to about 70% by weight, or even from about 40% by weight to about 65% by weight adsorbent.

The ambient applied desiccant matrix composition preferably includes both an adsorbent capable of adsorbing moisture and an adsorbent capable of adsorbing other volatile chemicals; preferably the desiccant matrix composition includes from about 20% by weight to about 70% by weight, or even from about 25% by weight to about 60% by weight of an adsorbent capable of adsorbing moisture, and no greater than 25% by weight, or even from 3% by weight to 20% by weight, of an adsorbent capable of adsorbing moisture and other volatile chemicals.

An adsorbent that is capable of removing both moisture and other volatile chemicals, such as molecular sieve 13x, can be employed as a portion or all of the adsorbent component of the composition. A preferred adsorbent mixture includes from about 70% by weight to about 99% by weight of an adsorbent capable of adsorbing moisture, such as molecular sieve 3A, and from about 1% by weight to about 30% by weight of an adsorbent capable of adsorbing organic vapor, such as molecular sieve 13x.

Suitable classes of catalysts include, e.g., organotin compounds, aliphatic titanates having from one to twelve carbon atoms (e.g., $C_1$-$C_{12}$ alkyl titanates and $C_1$-$C_{12}$ alkyl amines). Examples of useful catalysts include dibutyl tin dilaurate, dibutyl tin diacetate, tetrabutyl titanate, and tetraethyl titanate, and combinations thereof.

Useful organic-modified clays include a base clay component and organic groups attached to the base clay component. Useful base clay components include, e.g., smectite (e.g., montmorilonite and hectorite). Suitable organic groups include those organic groups attached to the base clay through reaction with quaternary ammonium chloride. Preferably the organic-modified clay includes hydroxyl groups. Suitable organic modified clays are commercially available under the CLAYTONE trade designation from Southern Clay Products (Gonzales, Tex.). Organic-modified clay is preferably present in the composition in an amount from 0.1% by weight to 3% by weight clay, from 0.5% by weight to 2% by weight clay, or even about 1% by weight.

Ambient applied desiccant matrix compositions may include other additives including, e.g., antioxidants, ultraviolet light stabilizers, thermal stabilizers, fillers pigments (e.g., titanium dioxide and carbon black), adhesion promoters and combinations thereof. Useful fine particulate fillers preferably have an average particle size of no greater than 0.1 micron. Suitable fillers include calcium carbonate fillers including, e.g., ULTRA-PFLEX calcium carbonate, which is available from Specialty Minerals (Pittsburgh, Pa.). Calcium carbonate filler is preferably present in the composition in amount no greater than 10% by weight, or even no greater than 5% by weight.

Examples of useful commercially available moisture curable ambient applied desiccant matrix compositions include compositions available under the product number TL-5042-M from H.B. Fuller Company (Vadnais Heights, Minn.), and under the trade designation SASHDRI 001 from H.B. Fuller Company (Vadnais Heights, Minn.).

Other suitable ambient applied, atmospheric curing desiccant compositions are described, e.g., in U.S. Pat. No. 6,136,910 (Vimelson) and incorporated herein.

Suitable ambient applied noncuring desiccant compositions are described, e.g., in U.S. patent application Ser. No. 10/446,439 filed May 28, 2003, entitled, "AMBIENT APPLIED DESICCANT MATRIX COMPOSITION," and incorporated herein.

Ambient applied desiccant matrix compositions are preferably applied at a temperature from 10° C. to less than 38° C., from 15° C. to 35° C., or even at room temperature (i.e., from 22° C. to 25° C.), using any suitable dispensing technique including, e.g., extruding and pumping.

Suitable hot melt desiccant matrix compositions and methods of making the same are described in, e.g., U.S. Pat. Nos. 5,503,884 (Meyer et al.), 5,509,984 (Meyer et al.), 5,510,416 (Meyer et al.), 5,632,122 (Spinks), 6,112,477 (Spinks), and 5,863,857 (Lamb et al.) and incorporated herein. Preferred hot melt desiccant matrix compositions have a viscosity no greater than 750,000 cPs, no greater than 300,000 cPs, no greater than 200,000 cPs, or even no greater than 100,000 cP at 177° C., and are applied at elevated temperatures, preferably a temperature from greater than 38° C. to no greater than 150° C., no greater than 135° C., no greater than 125° C., or even no greater than 110° C.

One example of a useful hot melt desiccant matrix composition is commercially available under the product number HL-5157-125 from H.B. Fuller Company.

The desiccant matrix composition of the insulating glass assembly can be in the form of a multilayer desiccant matrix composition that includes a first layer that is near or in contact with the spacing structure (e.g., the bottom wall of the channel of the spacing structure) and a second layer that is exposed to the airspace of the insulating glass assembly. Preferably the second layer is disposed on and contiguous with the first layer. The first layer, or matrix of the first layer when the first layer includes desiccant, preferably exhibits a lower moisture vapor transmission rate relative to the matrix of the second layer. Preferably the moisture vapor transmission rate of the first layer, or matrix of the first layer when the first layer includes desiccant, is sufficient to inhibit, preferably prevent, the transfer of volatile organic compounds, moisture, other volatile chemicals, or a combination thereof, though the first layer to the second layer. Preferably when the first layer is a hot melt, the first layer or the matrix of the first layer when the first layer includes desiccant, exhibits a moisture vapor transmission rate of no greater than 5 $g/m^2$/day, or even no greater than 2 $g/m^2$/day. The matrix of the second layer preferably exhibits a moisture vapor transmission rate of at least 5 $\mu m^2$/day, or even at least 10 $g/m^2$/day.

Each layer of the multilayer desiccant matrix composition that includes a desiccant matrix composition preferably has a moisture adsorption capacity of greater than 5%, or even from 8% to 15%.

Preferably the first layer of the multilayer desiccant matrix composition is capable of adsorbing volatiles (e.g., volatiles that result from off-gassing of the polymeric spacing structure, permeation through the spacing structure (e.g., from the atmosphere exterior to the spacing structure), and combinations thereof). The first layer preferably includes no greater than 60% by weight, or even from 5% by weight to 55% by weight adsorbent.

The second layer, i.e., the layer exposed to the atmosphere of the sealed chamber, includes from 30% by weight to 70% by weight, or even from 40% by weight to 65% by weight adsorbent.

Suitable compositions for the first layer of the multilayer desiccant matrix composition include, e.g., hot melt compositions, hot melt desiccant matrix compositions, and ambient applied desiccant matrix compositions. The second layer of the multilayer desiccant matrix composition is a desiccant matrix composition, suitable examples of which include hot melt desiccant matrix compositions and ambient applied desiccant matrix compositions.

Examples of suitable ambient applied desiccant matrix compositions include the above-described ambient applied desiccant matrix compositions.

The hot melt composition includes thermoplastic polymer. One useful hot melt composition includes polyisobutylene. Polyisobutylene is commercially available under the trade designation BOSTIK including BOSTIK 3523, 3524, and 3525 from Bostik Findley Inc. (Middleton, Mass.), ADCOTHERM from Adco (Michigan Center, Mich.), TRU-SEAL JS-780 and OPTI-BEAD from Truseal (Beachwood, Ohio), and CHEMETALL BU PIB from Chemetall (Frankfurt, Germany).

Other useful hot melt compositions include butyl-polymer, amorphous polyalpha-olefin and combinations thereof. The term "butyl-polymer" refers to polybutene, polyisobutylene, and combinations thereof. Useful polybutenes are commercially available under the trade designations INDOPOL H-1900 from BP, Inc. (Naperville, Ill.) and VISTANEX LM-MH trade designation from ExxonMobil Chemical Co. (Houston, Tex.). The composition preferably includes from 4% by weight to 75% by weight, from 8% by weight to 65% by weight, or even from 10% by weight to 50% by weight butyl-polymer.

Suitable amorphous polyalphaolefin polymers include amorphous polyalphaolefin polymers derived from propylene and ethylene/alpha-olefin interpolymers.

Useful amorphous polyalphaolefin polymers derived from propylene include, e.g., homopolymers, copolymers, terpolymers, and graft copolymers of propylene. The propylene-containing polymer preferably has low levels of volatile components such that the polymer does not contribute to fogging of a sealed insulating glass assembly. Useful propylene-containing polymers include, e.g., propylene-ethylene copolymers, butylene-propylene copolymers and terpolymers, and combinations thereof. Suitable amorphous propylene-containing polymers are commercially available under the EASTOFLEX series of trade designations including EASTOFLEX E-1003 and EASTOFLEX T1035 from Eastman Chemicals (Kingsport, Tenn.), and the REXTAC series of trade designations including REXTAC 2304 and REXTAC 2715 amorphous polyalphaolefins from Huntsman Corp. (Houston, Tex.). The propylene-containing polymer preferably is present in the hot melt desiccant matrix composition in an amount from 10% by weight to about 96% by weight, or even from 15% by weight to about 85% by weight.

The ethylene/alpha-olefin interpolymers are derived from ethylene and alpha-olefin comonomers. Useful alpha-olefin comonomers include $C_3$-$C_{20}$ alpha-olefins, cycloalkenes and non-conjugated dienes. Exemplary $C_3$-$C_{20}$ alpha-olefins include propylene, isobutylene, 1-butene, 1-hexene, 4-methyl-pentene, 1-heptene, and 1-octene. Preferred $C_3$-$C_{20}$ alpha-olefins include 1-butene, 1-hexene, 4-methyl-1-pentene, 1-heptene, and 1-octene, more preferably 1-hexene and 1-octene.

Useful cycloalkenes include, e.g., cyclopentene, cyclohexene, and cyclooctene.

Suitable non-conjugated dienes comonomers, particularly useful in the making of ethylene/alpha-olefin/diene terpolymers, include non-conjugated dienes having from 6 to 15 carbon atoms including, e.g., straight chain acyclic dienes (e.g., 1,4-hexadiene, 1,5-heptadiene, and 1,6-octadiene), branched chain acyclic dienes (e.g., 5-methyl-1,4-hexadiene, 3,7-dimethyl-1,6-octadiene, and 3,7-dimethyl-1,7-octadiene), single ring alicyclic dienes (e.g., 4-vinylcyclohexene, 1-allyl-4-isopropylidenecyclohexane, 3-allylcyclopentene, 4-allylcyclohexene, and 1-isopropenyl-4 butenylcyclohexene), multi-ring alicyclic fused ring dienes and multi-ring alicyclic bridged ring dienes (e.g., dicyclopentadiene, alkenyl, alkylidene, cycloalkenyl, and cycloalkylidene norbornenes (e.g., 5-methylene-2 norbomene, 5-methylene-6-methyl-2-norbornene, 5-methylene-6,6-dimethyl-2 norbornene, 5-propenyl-2-norbornene, 5-(3-cyclopentenyl)-2-norbornene, 5-ethylidene-2-norbornene, 5-cyclohexylidene-2-norbornene)). Preferred dienes include 1,4-hexadiene, dicyclopentadiene, 5-ethylidene-2-norbornene, 5-methylene-2-norbornene, 7-methyl-1,6-octadiene, piperylene, and 4-vinylcyclohexene.

Useful ethylene/alpha-olefin interpolymers are commercially available under the trade designations EXACT 5008, which is an ethylene-butene copolymer, EXXPOL SLP-0394, which is an ethylene-propylene copolymer, and Exact 3031, which is an ethylene-hexene copolymer, all of which are available from Exxon Mobil Co. (Houston, Tex.). Suitable ethylene/$C_3$-$C_{20}$ alpha-olefin interpolymers are also available from Dow Chemical Co. (Midland, Mich.) under the INSITE trade designation.

The hot melt composition preferably includes ethylene/alpha-olefin interpolymer in an amount from 0% by weight to 100% by weight, from 1% by weight to about 40% by weight, or even from 1% by weight to about 20% by weight.

The hot melt composition optionally includes tackifying agent. Suitable tackifying agents include, e.g., hydrogenated wood rosin, hydrocarbon tackifying resins, hydrogenated hydrocarbon resins and $C_5$/$C_9$ aliphatic aromatic tackifying resins, and combinations thereof. The composition preferably includes tackifying agent in an amount no greater than 30% by weight, or even from 0% by weight to about 15% by weight.

Other suitable hot melt compositions include the sealants described herein as well as polysulfide and polyurethane sealant compositions. An example of a commercially available polysulfide sealant composition is CHEMETALL M82 polysulfide from Chemetall (Germany).

The hot melt composition also optionally includes an adsorbent such that the composition is a hot melt desiccant matrix composition. Hot melt desiccant matrix compositions suitable for the multilayer construction include those hot melt desiccant matrix compositions set forth above. Suitable adsorbents for the hot melt desiccant matrix composition include the adsorbents described above in reference to the ambient applied desiccant matrix composition. Adsorbent is preferably present in the hot melt desiccant matrix composition in an amount no greater than 70% by weight, or even from 5% by weight to about 60% by weight. Preferably at least 5% by weight, or even from 30% by weight to about 60% by weight, of the hot melt desiccant matrix composition is a moisture adsorbing desiccant and no greater than 20% by weight, or even from about 1% by weight to 15% by weight, of the hot melt desiccant matrix composition is an adsorbent capable of adsorbing volatile chemicals.

The hot melt composition can also include additives including, e.g., pigment (e.g., titanium dioxide), carbon black, fillers, antioxidants, ultraviolet light and thermal stabilizers, adhesion promoters and combinations thereof. One example of a useful filler is calcium carbonate available under the trade designation HUBERCARB Q-325 from J.M. Huber Company (Quincy, Ill.).

The insulating glass assemblies can also include other components including, e.g., a vapor barrier. The vapor barrier impedes, and preferably prevents volatile organic compounds, moisture vapor or a combination thereof from entering the sealed air chamber. The vapor barrier can be positioned on the spacing structure to inhibit, or even prevent, organic vapor, moisture vapor, or a combination thereof, from escaping from the spacing structure into the airspace of the sealed chamber. The vapor barrier can also be positioned on at least one glazing surface to prevent moisture from entering in the sealed air chamber in the area between the glass pane and the spacer. The vapor barrier can be in the form of a coating, foil, a strip and combinations thereof, and can include metal, polymer, ceramic, and combinations thereof. Vapor barrier compositions and constructions are described, e.g., in U.S. Pat. Nos. 6,463,706 (Guhl), 6,401,428 (Glover et al.) and 4,015,394.

The glass panes of the insulating glass assembly are bonded to the spacing structure of the insulating glass assembly through a sealant. Useful classes of sealant compositions include, e.g., polyurethanes, polyisobutylenes, butyl rubbers, elastomers, natural and synthetic rubber, silicones, polysulfides, acrylates, and combinations thereof. Preferred sealant compositions include polar and/or reactive groups (e.g., silane, urethane, ester, mercapto, and combinations thereof) to provide sufficient covalent, and/or polar (e.g., hydrogen) bonding with the target substrates (e.g., polyvinyl chloride and glass). One example of a useful commercially available two-part moisture curable polyurethane sealant compositions is available under the UR 5100 series of trade designations from H.B. Fuller Company (Vadnais Heights, Minn.). Useful moisture curable sealants are commercially available, e.g., under the trade designations SASHSEAL 0001 and SASHSEAL 0002 from H.B. Fuller Company (Vadnais Heights, Minn.).

The sealants can be formulated to be hot melt, moisture curable, moisture curable hot melt, radiation curable, radiation curable-moisture curable hot melts, and combinations thereof.

One useful moisture curable sealant composition includes a polyurethane prepolymer having isocyanate functional groups, silane functional groups, or a combination thereof, a reactive plasticizer capable of reacting with at least one of the polyurethane prepolymer and itself, and thermoplastic polymer. Examples of useful moisture curable compositions are disclosed in U.S. Ser. No. 10/386,823, entitled, "Moisture Curable Hot Melt Sealants For Glass Constructions," filed on Mar. 11, 2003 and incorporated herein.

Another useful moisture curable hot melt sealant composition is a one part moisture curable silane-functional poly-alpha-olefin sealant that includes silane-functional poly-α-olefin, a thermoplastic component selected from a thermoplastic elastomer, a thermoplastic polymer and combinations thereof, and a tackifying agent. Examples of useful one-part moisture curable hot melt silane functional poly-α-olefin sealant compositions are disclosed in U.S. Ser. No.

10/385,834, entitled, "One-Part Moisture Curable Hot Melt Silane Functional Poly-Alpha-Olefin Sealant Composition," filed on Mar. 11, 2003 and incorporated herein.

One useful moisture curable, radiation curable sealant composition includes a moisture curable, radiation curable polyurethane prepolymer, a blend of a moisture curable polyurethane prepolymer and a radiation curable polymer, or a combination thereof and optionally includes at least 20% by weight filler. Examples of useful moisture curable, radiation curable compositions are disclosed in U.S. Ser. No. 10/387,360 entitled, "Moisture Curable, Radiation Curable Sealant Composition," filed on Mar. 11, 2003 and incorporated herein.

Other suitable sealant compositions include, e.g., a moisture curing polyurethane prepolymer that includes a) the reaction product of at least one isocyanate compound and at least one dihydroxy polyol selected from the group consisting of polyester polyols, polyether polyols, polyalkylene polyols and mixtures thereof; and b) at least one thermoplastic component as disclosed, e.g., in U.S. Pat. No. 6,355,317 (Reid et al.); sealant compositions that include a thermoplastic hot-melt resin having a melt temperature of from about 125° F. to about 250° F., and a silicon-containing atmospheric curing resin that polymerizes upon exposure to a component of the atmosphere (e.g., oxygen, water vapor, and combinations thereof), whereby the sealant is in a liquid phase at a temperature greater than about 77° F., reversibly solidifies upon cooling to about 77° F., and irreversibly solidifies upon subsequent exposure to the component of the atmosphere as disclosed, e.g., in U.S. Pat. No. 5,849,832 (Vimelson et al.); hot melt, single-component sealant compositions that include a styrene block copolymer, a moisture-curable silylated polyurethane prepolymer, an aromatic tackifier resin, a polar tackifier resin, polyethylene wax, and an organo functional silane as disclosed, e.g., in U.S. Pat. No. 6,121,354 (Chronister); and hot melt compositions that include reactive binder and non-reactive binder, where the reactive binder is silane-functional polyisobutylene, silane functional hydrogenated polybutadienes, silane functional polyalphaolefin or a combination thereof and the nonreactive binder is butyl rubber, polyalphaolefin, polybutene, styrene-block copolymer-based rubber, diene homopolymer or copolymer-based rubbers or a combination thereof as disclosed, e.g., Canadian Patent Application No. CA 2258585 (Grimm).

A primary sealant and a secondary sealant can be applied to the glazing surface. The primary sealant is formulated to prevent migration of air or argon or any other insulating gas out of the sealed air chamber and to prevent gases, e.g., water vapor, from migrating from the outside atmosphere into the sealed air chamber, which could cause condensation on the interior surfaces of the sealed air chamber. The primary sealant can be any composition that prevents such migration including, e.g., polyisobutylene. The secondary sealant provides an adhesive bond between the glass pane and the spacer. This adhesive bond prevents the first glass pane from separating from the spacer, and prevents water from flowing into the sealed air chamber. A single sealant composition can provide the function of the primary sealant and the secondary sealant. Examples of secondary sealants include hot melt butyl rubber, polyisobutylene, the sealants listed above, and combinations thereof. Suitable commercially available secondary sealants include, e.g., Dow Corning 1199 and Dow Corning 30117 silicone sealants available from Dow Corning (Midland, Mich.), GE SILGLAZE II silicone sealants available from General Electric (Dallas, Tex.).

The invention will now be further described by way of the following examples.

EXAMPLES

Test Procedures

Test procedures used in the examples include the following.

Canadian Fog Test Method

The presence of fog in an insulating glass assembly is determined according to the National Standard of Canada, Insulating Glass Units, CAN/CGSB-12.8-97 test method for Volatile Fogging 3.6.5 after the insulating glass assembly has been stored for at least one month at 23° C. and 50% relative humidity. The results are recorded as a pass or a fail.

Dew Point Depression Test Method

The dew point depression is determined according to ASTM E-546-88 entitled, "Standard Test Method for Frost Point of Sealed Insulating Glass Units." The dew point depression is measured and recorded according to ASTM E-546-88, which is incorporated herein, as the temperature at which condensation (e.g., frost) occurs within the sealed unit.

Accelerated Weathering Test Method

Accelerated weathering testing of insulating glass assemblies is conducted according to ASTM E774-88 entitled, "Standard Specification for Sealed Insulating Glass Units," in conjunction with ASTM E773-97 entitled, "Standard Test Method for Accelerated Weathering of Sealed Insulating Glass Units," hereinafter referred to as "ASTM E774/773," Class C performance requirements, Class CB performance requirements, and Class CBA performance requirements and incorporated herein. A pass or fail is assigned according to the criteria set forth therein.

Flow Rate Test Method

Flow rate is determined by measuring the time (in seconds) required for 20 grams of sample to pass through a 0.104 inch orifice of a Castor Severs Rheometer that has been configured according to ASTM D-1823 under a pressure of 80 psi.

A flowmeter is connected to an air supply such that the line pressure is from 10 psi to 20 psi greater than the line pressure specified for the test (i.e., from 90 psi to 100 psi) until the flowmeter gauge stabilizes at the test pressure, i.e., 80 psi. A weighing pan is placed in the center of the balance about three inches under the orifice of the rheometer. The balance is tared with the weighing pan in place. The sample temperature is adjusted to room temperature. The cylindrical cup is filled to ½ inch from the top and tapped sharply to avoid air pocket formation. The flowmeter piston disc or follower plate on the sample surface. The filled cup is then placed on the flowmeter. The air valve to the piston is opened and 5 grams of sample are extruded onto the weigh pan positioned on the balance. Then the air valve to the piston is turned off and the sample is discarded. A clean weigh pan is placed on the balance and the balance is tared again. The air valve is opened to the piston and another portion of sample is extruded. A stopwatch is started when the sample reaches the weigh pan and stopped when the balance indicates 20 g. The piston valve is then closed and the time in seconds is recorded as the flow rate of the material.

Slump Test Method

Slump is determined according to ASTM D2202-88 with the exception that slump is measured after 5 minutes at 77° F. The sample composition and the test jig are allowed to equilibrate at 77° F.+/−1° F. (25° C.+/−0.5° C.). The test jig is then placed, with front face upward and the plunger depressed to the limit of its travel (9 mm), the cavity on the front face of the jig is filled with sample composition. The cavity is filled with one stroke of the plastic scraper held at an angle of about 45 degrees to the face of the jig, while avoiding forming air bubbles in the cavity. The area around the cavity is cleaned of excess sample. The jig is turned to a vertical position and placed on a level surface while avoiding vibration. The jig is placed on its end and the plunger is slowly pushed to the full length of its travel such that a solid cylinder of sample measuring 3.81 cm (1 to 1-½") in diameter×0.125+/−0.001 inch high protrudes from the face of the test jig. A reading is taken after five to six minutes to nearest 0.01 inch of maximum point of flow of the compound.

Slump at 190° F.

Slump at 190° F. is determined by extruding a bead of composition, 0.25 in. wide×3 in. long×0.25 in. thick, onto a piece of flat aluminum stock. The test sample is then suspended vertically in a protected environment and conditioned at 190° F. for a predetermined period. The samples are then removed and observed to determine the distance traveled by the sample from its original position. The distance traveled is recorded to the nearest 0.1 inch.

Desiccant Matrix Composition 1

Prior to loading a mixer, KANEKA MS S303H silyl-terminated polyether polymer (KaneKagafuchi Chemical Company, Japan) is preheated in an oven set to 160° F. to 180° F. The ambient applied desiccant matrix composition is prepared by combining 20.31 g JAYFLEX DTDP ditridecylphthalate plasticizer (ExxonMobil, Houston, Tex.), 10.2 g preheated KANEKA MS S303H silyl-terminated polyether polymer (KaneKagafuchi), 0.2 g UV stabilizer, 1.02 g titanium dioxide, 0.01 g carbon black, 7.65 g calcium carbonate, and 48.98 g MOLSIV 3A adsorbent (UOP, Riverside, Ill.). The mixer is closed and vacuum is pulled to less than 28 inch Hg. Mixing is continued for 1 hour while a vacuum is maintained at less than 28 inch Hg and batch temperature is maintained at less than 200 F. MOLSIV 13X adsorbent (UOP), 10.2 g, is then added. A vacuum is pulled again and maintained at less than 28 inch Hg and mixing is continued for another two hours. The batch temperature is lowered to 120° F. and then 1.02 g CLAYTONE 40 organic modified clay (Southern Clay, Gonzales, Tex.) and 0.41 DABCO 131 catalyst are vacuum charged to the mixture. The mixing is continued under vacuum (less than 20 inch Hg) for another hour.

Desiccant Matrix Composition 2

A mixer is preheated prior to loading the raw materials. The hot melt desiccant matrix composition is prepared by combining 10 g XUS 58900.01 Dev. ethylene-octene copolymer (Dow Chemical, Midland Mich.), 5 g INDOPOL H-1900 polybutene (BP, Naperville, Ill.), 34 g EASTOFLEX E1003 propylene-ethylene copolymer (Eastman Chemical, Kingsport, Tenn.), 0.01 g carbon black, and 0.99 g titanium dioxide. Agitation is started for 10 minutes, after which time a vacuum is pulled to approximately 23 inches. Mixing is continued for another 1 hour and 15 minutes under vacuum, after which the vacuum is broken. MOLSIV 3A adsorbent (UOP, Riverside, Ill.) in an amount of 40 g and 10 g MOLSIV 13X adsorbent (UOP) is then added to the mixer and mixing is continued for another 45 minutes under 23 inch of vacuum.

Hot Melt Composition

The hot melt composition consisted of polyisobutylene from Chemetall (Frankfurt, Germany).

Sealant Composition 1

Sealant composition 1 is available under the trade designation SASHSEAL 0002 from H.B. Fuller Company (Vadnais Heights, Minn.).

Example 1

A double hung insulating sash assembly is prepared by dispensing 65 g of desiccant matrix composition 1 as a continuous bead in the U-shaped channel of an integral polyvinyl chloride (PVC) spacing structure of a sash frame in the desiccant matrix configuration illustrated in FIG. 4 using a modified EACYPLY hand-assist automated application equipment equipped with two dispensing heads, one for sealant and one for desiccant matrix composition from Erdman Automation Corp. (Princeton, Minn.). The sash is 16 inch×22 inch, which corresponds to an outer perimeter of 76 lineal inch. Desiccant matrix composition 1 is applied to the channel of the assembly in an amount of 10 g/lineal foot. The total amount of desiccant matrix composition (65 g) present in the channel is calculated by subtracting the weight of the sash from the weight of the sash frame plus desiccant matrix composition.

Sealant composition 1 is then dispensed on the glazing surface (i.e., the exterior surface) of the spacing structure on one side of the assembly, in the form of a continuous bead about 0.1 inch thick by about 0.15 inch wide. A glass pane (3/16 inch thick) is positioned against the sealant and the spacer. Pressure is applied at the bond line (i.e., the area of the sealant) by a roller wheel traveling along the perimeter of the glass pane of the assembly. The dwell time of the roller wheel on the glass pane is about 15 seconds, after which the sealant is compressed to about 0.03 in thick and about 0.5 inch wide.

The process is repeated on the opposite side of the assembly with a second pane of glass.

The dew point depression of the sealed assembly is measured after the assembly has been stored for 24 hours at room temperature. The assembly exhibits an expected dew point depression of less than −80° F.

The assembly is then stored at 50% relative humidity and 70° F. for at least 4 weeks after which the assembly is tested according to the Canadian Fog Test Method. The assembly is found to pass.

Example 2

A double hung insulating sash assembly is prepared according to the procedure of Example 1 with the following exceptions: the desiccant matrix composition is configured as illustrated in FIG. 2, about 130 g (instead of 65 g) of desiccant matrix composition 1 is used, the sealant composition is prepared as described in Example 3 of U.S. application Ser. No. 10/386,823 entitled, "MOISTURE CURABLE HOT MELT SEALANTS FOR GLASS CONSTRUCTIONS," and the glass panes are heated to a surface temperature of 150° F. prior to being positioned against the sealant and the spacing structure. Desiccant matrix composition 1 is applied to the channel of the assembly of Example 2 in an amount of 20 g/lineal foot.

Example 3

A double hung insulating sash assembly is prepared according to the procedure of Example 2 with the following exceptions: the glass panes are heated to a surface temperature of 115° F. prior to being positioned against the sealant and the spacing structure. Desiccant matrix composition 1 is applied to the channel of the assembly of Example 3 in an amount of 20 g/lineal foot.

Example 4

A casement insulating sash assembly is prepared by hand gunning about 45 g of desiccant matrix composition 2 heated to 210° F. using a heated dispensing gun, in the U-shaped channel of an integral PVC spacing structure of a sash frame, 24 inch×17.75 inch, having an outer perimeter of 83.5 lineal inch. The desiccant matrix composition is configured as illustrated in FIG. 6. Desiccant matrix composition 2 is applied to the channel of the assembly in an amount of 6 g/lineal foot.

Then, about 65 g of desiccant matrix composition 1 are dispensed in the U-shaped channel in the form of a continuous bead on top of the layer of desiccant matrix composition 2. Desiccant matrix composition 1 is applied in an amount of 10 g/lineal foot.

Sealant composition 1 is then dispensed on the glazing surface of the spacing structure on one side of the assembly in the form of a continuous bead of about 0.1 inch thick by about 0.15 inch wide. A glass pane (3/16 inch thick) is positioned against the sealant and the spacer. The process is then repeated using a second pane of glass on the other side of the assembly.

A suction probe is inserted in a 7/64 inch orifice that had been pre-drilled through the exterior surface of the spacing structure and a vacuum of 5 in of Hg is applied for about 15 seconds, after which the sealant is about 0.03 inch thick and 0.5 inch wide. The orifice is then sealed with a rope of polyisobutylene (PIB) and additional sealant is placed on top of the PIB.

Example 6

A casement insulating sash assembly is prepared according to Example 4 with the following exceptions: about 65 g (instead of 45 g) of desiccant matrix composition 2 is used, desiccant matrix composition 1 is applied to the channel of the assembly of Example 6 in an amount of 10 g/lineal foot, and desiccant matrix composition 2 is applied in an amount of 10 g/lineal foot.

Example 7

A double hung insulating sash assembly is prepared by hand gunning about 49 g of the hot melt composition at a temperature of about 305° F. into the U-shaped channel of an integral PVC spacing structure of a sash frame using a heated drum unloader with a hand-gun. The sash frame had an outer perimeter of 22 inch×16 inch. The desiccant matrix is configured as illustrated in FIG. 8. The hot melt composition is applied to the channel of the assembly of Example 7 in an amount of 6 g/lineal foot.

Then, about 55 g of desiccant matrix composition 1 is dispensed in the form of a continuous bead on top of the layer of hot melt composition in an amount of 8 g/lineal foot.

Then the sealant composition described in Example 3 of U.S. application Ser. No. 10/386,823 entitled, "MOISTURE CURABLE HOT MELT SEALANTS FOR GLASS CONSTRUCTIONS," is dispensed on the glazing surface of the spacing structure of one side of the assembly, in the form of a continuous bead of about 0.1 inch thick by about 0.15 inch wide. A glass pane (3/16 inch thick), heated to a surface temperature of 115° F., is positioned against the sealant and the spacer. Pressure is applied at the bond line by a 1 inch diameter roller wheel traveling along the perimeter of the glass pane of the assembly. The dwell time of the roller wheel on the glass pane is about 15 seconds, after which the sealant is compressed to about 0.03 in thick and about 0.5 inch wide.

The process is repeated on the opposite side of the assembly with a second pane of glass heated to a surface temperature of 115° F.

Example 8

A double hung insulating sash assembly is prepared as described in Example 7 with the following exceptions: 36 g (instead of 49 g) of hot melt composition is used and 56 g (instead of 55 g) of desiccant matrix composition 1 is used.

Example 9

A double hung insulating sash assembly is prepared as described in Example 7 with the following exceptions: 32 g (instead of 49 g) of hot melt composition is used and 54 g (instead of 55 g) of desiccant matrix composition 1 is used.

Example 10

A casement insulating glass assembly is prepared as described in Example 1 with the following exceptions: the amount of desiccant composition is about 247 g, the desiccant matrix is configured as illustrated in FIG. 2, the sash had an outer perimeter of 24 inch×17.75 inch, and the desiccant matrix composition is applied to the channel of the assembly of Example 10 in an amount of 35 g/lineal foot.

The sealant composition described in Example 3 of U.S. application Ser. No. 10/386,823 entitled, "MOISTURE CURABLE HOT MELT SEALANTS FOR GLASS CONSTRUCTIONS," is then dispensed on the glazing surface of the spacing structure of one side of the assembly in a continuous bead about 0.01 inch thick by about 0.2 inch wide. A glass pane (3/16 inch thick) is positioned against the sealant and the spacer.

The process is repeated on the opposite side of the assembly with a second pane of glass.

A 7/64 inch orifice is then drilled through the exterior surface of the spacing structure and a suction probe is used to apply a vacuum of 5 in of Hg for about 15 seconds, after which the sealant is about 0.03 inch thick and about 0.5 inch wide. The orifice is then sealed with a rope of polyisobutylene (PIB) and additional sealant is placed on top of the PIB.

Example 11

A double hung insulating glass assembly is prepared as described in Example 10 with the following exceptions: about 108 g of desiccant matrix composition 1 is used, the outer sash perimeter is 22 inch×16 inch, the sealant composition is sealant composition 1, and the desiccant matrix composition is applied to the channel of the assembly of Example 11 in an amount of 17 g/lineal foot.

Example 12

A double hung insulating glass assembly was prepared by dispensing about 61.2 g desiccant matrix composition 1 in a continuous bead inside the U-shaped channel of a PVC spacing structure of a double hung type sash frame having an outer perimeter of 16 inch×22 inch. The desiccant matrix composition was applied to the channel of the assembly of Example 12 in an amount of 10 g/lineal foot.

Sealant composition, prepared according to Example 3 of U.S. patent application Ser. No. 10/386,823 entitled, "MOISTURE CURABLE HOT MELT SEALANTS FOR GLASS CONSTRUCTIONS" filed Mar. 11, 2003, was dispensed on the glazing surface of the spacing structure of one side of the assembly in a continuous bead of about 0.04 inch thick by about 0.2 inch wide. A glass pane (3/16 inch) was positioned against the sealant and the bond line. The dwell time was about 15 seconds, after which the sealant was compressed to about 0.03 inch thick×0.45 inch wide. The same process was repeated on the other side of the assembly.

Example 13

A patio insulating sash assembly is prepared by dispensing 70 g of Desiccant Matrix Composition 2 as a U-shaped continuous bead so as to cover the interior surface of the U-shaped channel of an integral polyvinyl chloride (PVC) spacing structure of a sash frame, according to the desiccant matrix configuration illustrated in FIG. 13, using a modified EACYPLY hand-assist automated application equipment equipped with two dispensing heads, one for sealant and one for desiccant matrix composition from Erdman Automation Corp. (Princeton, Minn.). The sash is 19 inch×25 inch, which corresponds to an outer perimeter of 88 lineal inch. Desiccant Matrix Composition 2 is applied to the interior surface of the channel of the assembly in an amount of 10 g/lineal foot. The total amount of desiccant matrix composition (70 g) present in the channel is calculated by subtracting the weight of the sash from the weight of the sash frame plus desiccant matrix composition.

Sealant composition 1 is then dispensed on the glazing surface of the spacing structure on one side of the assembly in the form of a continuous bead of about 0.1 inch thick by about 0.15 inch wide. A glass pane (3/16 inch thick) is positioned against the sealant and the spacer. The process is repeated on the opposite side of the assembly with a second pane of glass.

A suction probe is put in a 1/8 inch orifice in the spacing structure, which had been pre-drilled through the exterior surface of the spacing structure, and a vacuum of 15 in $H_2O$ is pulled for about 15 seconds, after which the sealant is about 0.03 inch thick and 0.5 inch wide. The orifice is then sealed with a sealant.

The insulating glass assemblies of Examples 1-13 are tested according to the Canadian Fog Test Method, the Dew Point Depression test methods, flow rate and the Conditioning test method. The expected results are reported in Table 1.

TABLE 1

| | Expected Results: | | | | |
|---|---|---|---|---|---|
| | Dew Point Depression (° F.) One Week | Canadian Fog After 30 days | Amount of Desiccant matrix (g/lineal foot) | Accelerated Weathering | Sash Type |
| Example 1 | −80 | Pass | 10 | Passes Class CBA | Double Hung |
| Example 2 | −80 | Pass | 20 | NA | Double Hung |
| Example 3 | −80 | Pass | 20 | NA | Double Hung |
| Example 4 | −80 | NA | 6-10 | NA | Casement |
| Example 6 | −80 | NA | 10-10 | NA | Casement |
| Example 7 | −80 | Pass | 6-8 | NA | Double Hung |
| Example 8 | −80 | Pass | 6-8 | NA | Double Hung |
| Example 9 | −80 | NA | 6-8 | Passes Class C | Double Hung |
| Example 10 | −80 | Pass | 35 | NA | Casement |
| Example 11 | −80 | NA | 17 | NA | Double Hung |
| Example 12 | −80 | NA | 10 | Passes Class CBA | Double Hung |
| Example 13 | −80 | Pass | 10 | NA | Patio |

NA = Not Available

Other embodiments are within the claims.

What is claimed is:

1. An insulating glass assembly comprising:

a) a polymeric spacing structure comprising
 i) a first side wall,
 ii) a second side wall, and
 iii) a third wall at least substantially perpendicular to the first side wall and the second side wall;

b) a first pane of glass bonded to the first side wall through a sealant composition;

c) a second pane of glass bonded to the second side wall through a sealant composition; and d) a multilayer desiccant matrix composition in contact with the spacing structure, said multilayer desiccant matrix composition comprising
 a first layer and
 a second layer disposed on and contiguous with said first layer,
 said first layer exhibiting a lower moisture vapor transmission rate than said second layer.

2. An insulating glass assembly comprising:

a) a polymeric spacing structure comprising
 i) a first side wall,
 ii) a second side wall, and
 iii) a third wall at least substantially perpendicular to the first side wall and the second side wall;

b) a first pane of glass bonded to the first side wall through a sealant composition;

c) a second pane of glass bonded to the second side wall through a sealant composition; and d) a desiccant matrix composition in contact with the spacing structure, the desiccant matrix composition comprising adsorbent and polymer, the desiccant matrix composition comprising multilayer desiccant matrix composition comprising
 a first layer comprising an ambient applied desiccant matrix composition having a flow rate of at least 5 seconds at 25° C. and comprising polymer and at least 15% by weight adsorbent, and a second layer comprising an ambient applied desiccant matrix composition having a flow rate of at least 5 seconds at 25° C. and comprising a polymer and at least 30% by weight adsorbent, the ambient applied composition of the second layer being different from the ambient applied composition of the first layer, the second layer being exposed to the airspace of the chamber formed by the spacer and the first and second panes of glass, the insulating glass assembly, when tested according to the Canadian Fog Test Method, passes.

3. An insulating glass assembly comprising:

a) a polymeric spacing structure comprising i) a first side wall, ii) a second side wall, and iii) a third wall at least substantially perpendicular to the first side wall and the second side wall;

b) a first pane of glass bonded to the first side wall through a sealant composition;

c) a second pane of glass bonded to the second side wall through a sealant composition; and d) a desiccant matrix composition in contact with the spacing structure, the desiccant matrix composition comprising a multilayer desiccant matrix composition comprising i. a first layer comprising a hot melt applied desiccant matrix composition comprising a. thermoplastic polymer, and b. adsorbent, the hot melt applied desiccant matrix composition having a viscosity no greater than 750,000 centipoise at 177° C.; and ii. a second layer comprising a hot melt applied desiccant matrix composition comprising a. thermoplastic polymer, and b. adsorbent, the hot melt applied desiccant matrix composition of the second layer having a viscosity no greater than 750,000 centipoise at 177° C., the hot melt applied desiccant matrix composition of the second layer being different from the hot melt applied desiccant matrix composition of the first layer, the insulating glass assembly, when tested according to the Canadian Fog Test Method, passes.

4. An insulating glass assembly comprising:

a) a polymeric spacing structure comprising i) a first side wall, ii) a second side wall, and iii) a third wall at least substantially perpendicular to the first side wall and the second side wall;

b) a first pane of glass bonded to the first side wall through a sealant composition;

c) a second pane of glass bonded to the second side wall through a sealant composition; and d) a desiccant matrix composition in contact with the spacing structure, the desiccant matrix composition comprising adsorbent and polymer, the desiccant matrix composition comprises a multilayer desiccant matrix composition comprising a first layer comprising a composition selected from the group consisting of a hot melt composition comprising thermoplastic polymer and an ambient applied desiccant matrix composition comprising polymer and adsorbent having a flow rate of at least 5 seconds at 25° C., and a second layer comprising a desiccant matrix composition selected from the group consisting of a hot melt composition comprising thermoplastic polymer and adsorbent and an ambient applied composition having a flow rate of at least 5 seconds at 25° C. and comprising a polymer and adsorbent, the second layer being exposed to the airspace of the chamber formed by the spacer and the first and second panes of glass, the insulating glass assembly, when tested according to the Canadian Fog Test Method, passes.

5. The insulating glass assembly of claim 4, wherein the composition of the first layer exhibits a MVTR of no greater than 5 $g/m^2/day$.

6. The insulating glass assembly of claim 4, wherein the matrix of the composition of the second layer exhibits an MVTR of at least 5 $g/m^2/day$.

7. The insulating glass assembly of claim 4, wherein the composition of the first layer exhibits an MVTR that is less than the MVTR of the matrix of the composition of the second layer.

8. The insulating glass assembly of claim 4, wherein the polymer of the composition of the first layer comprises polyisobutylene.

9. The insulating glass assembly of claim 4, wherein the polymer of the composition of the second layer comprises silane-functional polymer.

10. The insulating glass assembly of claim 4, wherein the composition of the first layer comprises a hot melt composition and the desiccant matrix composition of the second layer comprises an ambient applied desiccant matrix composition.

* * * * *